US009315929B2

(12) United States Patent
Sheehan

(10) Patent No.: US 9,315,929 B2
(45) Date of Patent: Apr. 19, 2016

(54) NON-WOVENS WITH HIGH INTERFACIAL PORE SIZE AND METHOD OF MAKING SAME

(75) Inventor: Astrid Annette Sheehan, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1129 days.

(21) Appl. No.: 12/237,419

(22) Filed: Sep. 25, 2008

(65) Prior Publication Data

US 2009/0087475 A1 Apr. 2, 2009

Related U.S. Application Data

(60) Provisional application No. 60/997,144, filed on Oct. 1, 2007, provisional application No. 60/995,728, filed on Sep. 28, 2007.

(51) Int. Cl.
*B65D 73/00* (2006.01)
*D04H 1/46* (2012.01)

(52) U.S. Cl.
CPC ..... *D04H 1/465* (2013.01); *Y10T 428/24479* (2015.01)

(58) Field of Classification Search
CPC ..... D04H 1/00; D04H 1/72; D04H 1/74; D04H 13/00; B65D 73/00
USPC ..... 206/494, 812; 19/296, 299, 301
See application file for complete search history.

(56) References Cited

U.S. PATENT DOCUMENTS

| | | | |
|---|---|---|---|
| 3,485,706 | A | 12/1969 | Evans |
| 3,800,364 | A | 4/1974 | Kalwaites |
| 3,917,785 | A | 11/1975 | Kalwaites |
| 4,379,799 | A | 4/1983 | Holmes |
| 4,588,457 | A | 5/1986 | Crenshaw et al. |
| 4,665,597 | A | 5/1987 | Suzuki |
| 4,718,152 | A | 1/1988 | Suzuki |
| 4,868,958 | A | 9/1989 | Suzuki |
| 4,981,557 | A | 1/1991 | Bjorkquist |
| 5,115,544 | A | 5/1992 | Widen |
| 5,143,679 | A | 9/1992 | Weber et al. |

(Continued)

FOREIGN PATENT DOCUMENTS

| | | |
|---|---|---|
| EP | 0 511 025 A1 | 10/1992 |
| EP | 1 002 746 A1 | 5/2000 |

(Continued)

OTHER PUBLICATIONS

Dietz, T., Basic properties of cosmetic oils and their relevance to emulsion preparations. SÖFW—Journal, Jul. 1999, pp. 1-7.

(Continued)

*Primary Examiner* — Mickey Yu
*Assistant Examiner* — Rafael Ortiz
(74) *Attorney, Agent, or Firm* — George H. Leal

(57) ABSTRACT

A Nonwoven fibrous structures with a high interfacial pore size and substrates made therefrom are provided. The substrates may be used, for example, in wipes. In one embodiment, the wipes include a hydromolded pattern on one side. The hydromolded pattern has an average pore-size of the interface between two stacked wipes that is greater than 180 microns in radius. In addition, a method for manufacturing nonwoven fibrous structures with high interfacial pore size is also provided.

14 Claims, 8 Drawing Sheets

(56) References Cited

U.S. PATENT DOCUMENTS

| | | | | |
|---|---|---|---|---|
| 5,397,435 | A | 3/1995 | Ostendorf et al. | |
| 5,405,501 | A | 4/1995 | Phan et al. | |
| 5,518,801 | A | 5/1996 | Chappell et al. | |
| 5,628,097 | A | 5/1997 | Benson et al. | |
| 5,658,639 | A * | 8/1997 | Curro et al. | 428/131 |
| 5,914,084 | A | 6/1999 | Benson et al. | |
| 5,916,661 | A | 6/1999 | Benson et al. | |
| 6,114,263 | A | 9/2000 | Benson et al. | |
| 6,129,801 | A | 10/2000 | Benson et al. | |
| 6,172,276 | B1 * | 1/2001 | Hetzler et al. | 604/378 |
| 6,361,784 | B1 | 3/2002 | Brennan | |
| 6,383,431 | B1 | 5/2002 | Dobrin et al. | |
| 6,395,957 | B1 * | 5/2002 | Chen et al. | 604/381 |
| 7,037,569 | B2 | 5/2006 | Curro et al. | |
| 7,696,109 | B2 * | 4/2010 | Ouellette et al. | 442/123 |
| 7,799,968 | B2 * | 9/2010 | Chen et al. | 604/379 |
| 2004/0116031 | A1 * | 6/2004 | Brennan et al. | 442/401 |
| 2004/0131820 | A1 | 7/2004 | Turner et al. | |
| 2004/0154768 | A1 | 8/2004 | Trokhan et al. | |
| 2004/0157524 | A1 | 8/2004 | Polat et al. | |
| 2004/0265534 | A1 * | 12/2004 | Curro et al. | 428/92 |
| 2005/0148264 | A1 * | 7/2005 | Varona et al. | 442/382 |
| 2006/0063456 | A1 * | 3/2006 | Carter | 442/327 |
| 2006/0121099 | A1 * | 6/2006 | Solarek | 424/443 |
| 2007/0049153 | A1 * | 3/2007 | Dunbar et al. | 442/400 |
| 2007/0228064 | A1 * | 10/2007 | Brennan et al. | 221/45 |
| 2008/0135572 | A1 * | 6/2008 | Brennan et al. | 221/48 |

FOREIGN PATENT DOCUMENTS

| | | | |
|---|---|---|---|
| GB | 2 114 173 | A | 8/1983 |
| WO | WO 03/050339 | A1 | 6/2003 |

OTHER PUBLICATIONS

International Search Report and Written Opinion, mailed Feb. 25, 2009, PCT/US2008/011237.

Liquid Porosimety New Methodology and Applications. Journal of Colliod and Interface Science 162, 163-170 (1994), 8 pages.

* cited by examiner

NON-WOVENS WITH HIGH INTERFACIAL PORE SIZE AND METHOD OF MAKING SAME

CROSS REFERENCE TO RELATED APPLICATIONS

This application claims the benefit of U.S. Provisional Application Ser. No. 60/997,144, filed on Oct. 1, 2007 and U.S. Provisional Application Ser. No. 60/995,728, filed on Sep. 28, 2007 each of which is incorporated herein by reference in its entirety.

FIELD OF THE INVENTION

Nonwoven fibrous structures with a high interfacial pore size and substrates made therefrom are provided. A method for manufacturing nonwoven fibrous structures with high interfacial pore size is also provided.

BACKGROUND OF THE INVENTION

Various types of nonwoven fibrous structures have been utilized as disposable substrates. Nonwovens may differ in visual and tactile properties due to the particular production processes used in their manufacture. In addition to functional attributes, such as cleaning ability, consumers of disposable substrates, such as baby wipes, desire properties such as, strength, thickness, flexibility, texture and softness.

Wipes, such as baby wipes, are typically dispensed from packages. Examples of dispensing package configurations include: "flat pack" or non-interleaved configurations in which the wipes are stacked upon one-another and the consumer must separate each wipe from the stack during dispensing; perforated-roll configurations in which the wipes are arranged in a continuous roll with line of weakness which allow the individual wipes to separate from the continuous roll during dispensing; and "pop-up" or interleaved configuration in which the individual wipes are folded with overlapping sections and stacked so that a portion of each subsequent wipe is pulled through the dispensing orifice of the package when the previous wipe is dispensed.

When dispensed from their package, wipes may or may not dispense efficiently. For example, when dispensed from a pop-up configuration, wipes may dispense efficiently, meaning that each wipe is dispensed individually, and each time a wipe is dispensed, the subsequent wipe is pulled-through the dispensing orifice, and made available for subsequent dispensing. Alternately, wipes may experience problems during dispensing and dispense inefficiently. For example, when dispensed from a pop-up configuration multiple-wipes may be pulled-through the dispensing orifice during the dispensing of an individual wipe. This may result when the wipe being dispensed adheres too strongly to the subsequent wipe, so that the other dispensing forces (e.g. the frictional force between the subsequent wipe and the dispensing orifice) are insufficient to pull the wipes apart.

SUMMARY OF THE INVENTION

A Nonwoven fibrous structures with a high interfacial pore size and substrates made therefrom are provided. The substrates may be used, for example, in wipes. In one embodiment, the wipes include a hydromolded pattern on one side. The hydromolded pattern has an average pore-size of the interface between two stacked wipes that is greater than 180 microns in radius. In addition, a method for manufacturing nonwoven fibrous structures with high interfacial pore size is also provided.

DETAILED DESCRIPTION OF THE INVENTION

Definitions

Figure 1:
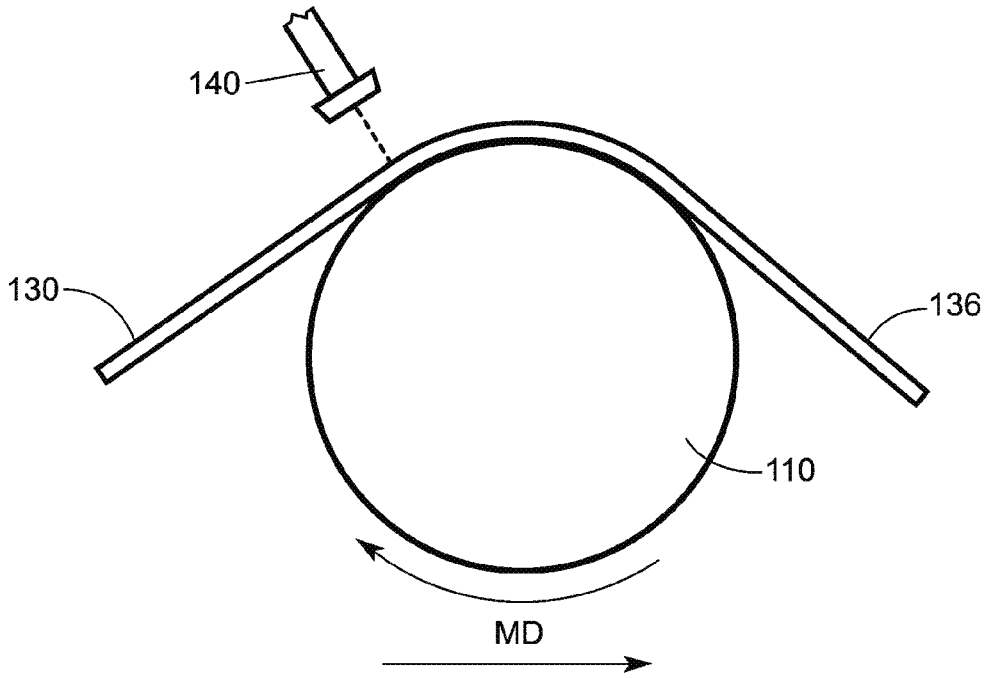
FIG. 1 is a cross sectional view of an exemplary hydromolding process.

"Air-laying" is a process whereby air is used to separate, move, and randomly deposit fibers to form a substantially coherent, and largely isotropic fibrous web.

"Basis Weight" is the weight (measured in grams) of a unit area (typically measured in square meters) of a fibrous structure, which unit area is taken in the plane of the fibrous structure.

"Carding" is a mechanical process whereby clumps of fibers are substantially separated into individual fibers and made into a coherent fibrous web.

"Co-forming" includes a spun-melt process, in which particulate matter, typically cellulose-pulp, is entrained in quenching air, so that the particulate matter becomes bound to semi-molten fibers during the fiber formation process.

"Fibrous Structure" is an arrangement that includes a plurality of synthetic fibers, natural fibers, and/or combinations thereof. The synthetic and/or natural fibers may be layered, as known in the art, to form the fibrous structure. The fibrous structure may be a nonwoven. The fibrous structure may be formed from a fibrous web and may be a precursor to a substrate.

"gsm" refers herein to "grams per square meter."

"Molding Member" is a structural element that can be used as a support for a fibrous web. The molding member may "mold" a desired geometry to the fibrous structure. The molding member may include a molding pattern that is imparted onto a fibrous web being conveyed thereon to produce a molded fibrous structure with a molded pattern thereon.

"Nonwoven" refers to a fibrous structure made from an assembly of continuous fibers, co-extruded fibers, non-continuous fibers and combinations thereof, without weaving or knitting, by processes such as spunbonding, carding, melt-blowing, air-laying, wet-laying, co-form, or other such processes. The nonwoven structure may comprise one or more layers of such fibrous assemblies.

"Spun-melt" includes both spun-laying and melt-blowing. Spun-laying is a process whereby fibers are extruded from a melt during the making of a coherent web. The fibers are formed by the extrusion of molten fiber material through fine capillary dies, and quenched, typically in air, prior to laying. In melt-blowing, the air-flow used during quenching is typically greater than in spun-laying, and the resulting fibers are typically finer, due to the drawing-influence of the increased air-flow.

"Substrate" refers herein to a piece of material, which is generally a non-woven piece of material. A "substrate" may also be known as a "wipe" and both terms may be used interchangeably.

Fibrous Web

The fibrous web may consist of any web, mat, or batt of loose fibers, disposed in relationship with one another in some degree of alignment, such as might be produced by carding, air-laying, spunbonding, and the like. The fibrous web may be a precursor to a nonwoven molded fibrous structure. The fibers of the fibrous web, and subsequently the nonwoven molded fibrous structure, may be any natural, cellulosic, and/or wholly synthetic material. Examples of natural fibers may include cellulosic natural fibers, such as fibers from hardwood sources, softwood sources, or other non-wood plants. The natural fibers may comprise cellulose, starch and combinations thereof. Non-limiting examples of suitable cellulosic natural fibers include, but are not limited to, wood pulp, typical northern softwood Kraft, typical southern softwood Kraft, typical CTMP, typical deinked, corn pulp, acacia, eucalyptus, aspen, reed pulp, birch, maple, radiata pine and combinations thereof. Other sources of natural fibers from plants include, but are not limited to, albardine, esparto, wheat, rice, corn, sugar cane, papyrus, jute, reed, sabia, raphia, bamboo, sidal, kenaf, abaca, sunn, rayon (also known as viscose), lyocell, cotton, hemp, flax, ramie and combinations thereof. Yet other natural fibers may include fibers from other natural non-plant sources, such as, down, feathers, silk, cotton and combinations thereof. The natural fibers may be treated or otherwise modified mechanically or chemically to provide desired characteristics or may be in a form that is generally similar to the form in which they can be found in nature. Mechanical and/or chemical manipulation of natural fibers does not exclude them from what are considered natural fibers with respect to the development described herein.

The synthetic fibers can be any material, such as, but not limited to, those selected from the group consisting of polyesters (e.g., polyethylene terephthalate), polyolefins, polypropylenes, polyethylenes, polyethers, polyamides, polyesteramides, polyvinylalcohols, polyhydroxyalkanoates, polysaccharides, and combinations thereof. Further, the synthetic fibers can be a single component (i.e., single synthetic material or mixture makes up entire fiber), bi-component (i.e., the fiber is divided into regions, the regions including two or more different synthetic materials or mixtures thereof and may include co-extruded fibers and core and sheath fibers) and combinations thereof. It is also possible to use bicomponent fibers. These bicomponent fibers can be used as a component fiber of the structure, and/or they may be present to act as a binder for the other fibers present in the fibrous structure. Any or all of the synthetic fibers may be treated before, during, or after the process to change any desired properties of the fibers. For example, in certain embodiments, it may be desirable to treat the synthetic fibers before or during processing to make them more hydrophilic, more wettable, etc.

In certain embodiments, it may be desirable to have particular combinations of fibers to provide desired characteristics. For example, it may be desirable to have fibers of certain lengths, widths, coarseness or other characteristics combined in certain layers or separate from each other. The fibers may be of virtually any size and may have an average length from about 1 mm to about 60 mm. Average fiber length refers to the length of the individual fibers if straightened out. The fibers may have an average fiber width of greater than about 5 micrometers. The fibers may have an average fiber width of from about 5 micrometers to about 50 micrometers. The fibers may have a coarseness of greater than about 5 mg/100 m. The fibers may have a coarseness of from about 5 mg/100 m to about 75 mg/100 m.

The fibers may be circular in cross-section, dog bone shaped, delta (i.e., triangular cross-section), tri-lobal, ribbon, or other shapes typically produced as staple fibers. Likewise, the fibers can be conjugate fibers, such as bicomponent fibers. The fibers may be crimped, and may have a finish, such as a lubricant, applied.

The fibrous web of an embodiment may have a basis weight of between about 30, 40 or 45 gsm and about 50, 55, 60, 65, 70, or 75 gsm. Fibrous webs may be available from the J.W. Suominen Company of Finland, and sold under the FIBRELLA trade name. For example, FIBRELLA 3100 and FIBRELLA 3160 have been found to be useful as fibrous webs. FIBRELLA 3100 is a 62 gsm nonwoven web comprising 50% 1.5 denier polypropylene fibers and 50% 1.5 denier viscose fibers. FIBRELLA 3160 is a 58 gsm nonwoven web comprising 60% 1.5 denier polypropylene fibers and 40% 1.5 denier viscose fibers. In both of these commercially available fibrous webs, the average fiber length is about 38 mm. Additional fibrous webs available from Suominen may include a 62 gsm nonwoven web comprising 60% polypropylene fibers and 40% viscose fibers; a fibrous web comprising a basis weight from about 50 or 55 to about 58 or 62 and comprising 60% polypropylene fibers and 40% viscose fibers; and a fibrous web comprising a basis weight from about 62 to about 70 or 75 gsm. The latter fibrous web may comprise 60% polypropylene fibers and 40% viscose fibers.

Molded Fibrous Structure

The fibrous web is the converted to a fibrous structure by conveying it over a molding member and subjecting the fibrous web to a hydro-molding process. The molding member may comprise a molding pattern of raised areas, lowered areas, and combinations thereof interspersed thereon. The molding member may impart the pattern onto the fibrous web during a hydro-molding process step thereby forming a fibrous structure having a molded pattern.

The molding pattern of raised and/or lowered areas may include images, graphics and combinations thereof and may include logos, indicia, trademarks, geometric patterns, images of the surfaces that a substrate (as discussed herein) is intended to clean (i.e., infant's body, face, etc.) and combinations thereof. They may be utilized in a random or alternating manner or they may be used in a consecutive, repeating manner. The images, graphics and combinations thereof may be a single image or graphic, a group of images or graphics, a repeating pattern of images or graphics, a continuous image or graphic, and combinations thereof.

The molding pattern may comprise a continuous lowered portion interspersed with discrete raised portions. The molding pattern may comprise a continuous raised portion interspersed with discrete lowered portions. The raised portion may comprise about 50% of the total surface area of the fibrous structure. Alternately, the raised portion may comprise about 45%, 40%, 35%, 30%, 25%, 20% or 15% of the surface area of the fibrous structure.

The fibrous structure may take a number of different forms. The fibrous structure may comprise 100% synthetic fibers or may be a combination of synthetic fibers and natural fibers. In one embodiment, the fibrous structure may include one or more layers of a plurality of synthetic fibers mixed with a plurality of natural fibers. The synthetic fiber/natural fiber mix may be relatively homogeneous in that the different fibers may be dispersed generally randomly throughout the layer. The fiber mix may be structured such that the synthetic fibers and natural fibers may be disposed generally non-randomly. In one embodiment, the fibrous structure may include at least one layer comprising a plurality of natural fibers and at least one adjacent layer comprising a plurality of synthetic fibers. In another embodiment, the fibrous structure may include at least one layer that includes a plurality of synthetic fibers homogeneously mixed with a plurality of natural fibers and at least one adjacent layer that includes a plurality of natural fibers. In an alternate embodiment, the fibrous structure may include at least one layer that includes a plurality of natural fibers and at least one adjacent layer that may comprise a mixture of a plurality of synthetic fibers and a plurality of natural fibers in which the synthetic fibers and/or natural fibers may be disposed generally non-randomly. Further, one or more of the layers of mixed natural fibers and synthetic fibers may be subjected to manipulation during or after the formation of the fibrous structure to disperse the layer or layers of mixed synthetic and natural fibers in a predetermined pattern or other non-random pattern.

The fibrous structure may further include binder materials. The fibrous structure may include from about 0.01% to about 1%, 3%, or 5% by weight of a binder material selected from a group of permanent wet strength resins, temporary wet strength resins, dry strength resins, retention aid resins and combinations thereof.

If permanent wet strength is desired, the binder materials may be selected from the group of polyamide-epichlorohydrin, polyacrylamides, styrene-butadiene latexes, insolubilized polyvinyl alcohol, ureaformaldehyde, polyethyleneimine, chitosan polymers and combinations thereof.

If temporary wet strength is desired, the binder materials may be starch based. Starch based temporary wet strength resins may be selected from the group of cationic dialdehyde starch-based resin, dialdehyde starch and combinations thereof. The resin described in U.S. Pat. No. 4,981,557, issued Jan. 1, 1991 to Bjorkquist may also be used.

If dry strength is desired, the binder materials may be selected from the group of polyacrylamide, starch, polyvinyl alcohol, guar or locust bean gums, polyacrylate latexes, carboxymethyl cellulose and combinations thereof.

A latex binder may also be utilized. Such a latex binder may have a glass transition temperature from about 0° C., −10° C., or −20° C. to about −40° C., −60° C., or −80° C. Examples of latex binders that may be used include polymers and copolymers of acrylate esters, referred to generally as acrylic polymers, vinyl acetate-ethylene copolymers, styrene-butadiene copolymers, vinyl chloride polymers, vinylidene chloride polymers, vinyl chloride-vinylidene chloride copolymers, acrylo-nitrile copolymers, acrylic-ethylene copolymers and combinations thereof. The water emulsions of these latex binders usually contain surfactants. These surfactants may be modified during drying and curing so that they become incapable of rewetting.

Methods of application of the binder materials may include aqueous emulsion, wet end addition, spraying and printing. At least an effective amount of binder may be applied to the fibrous structure. Between about 0.01% and about 1.0%, 3.0% or 5.0% may be retained on the fibrous structure, calculated on a dry fiber weight basis. The binder may be applied to the fibrous structure in an intermittent pattern generally covering less than about 50% of the surface area of the structure. The binder may also be applied to the fibrous structure in a pattern to generally cover greater than about 50% of the fibrous structure. The binder material may be disposed on the fibrous structure in a random distribution. Alternatively, the binder material may be disposed on the fibrous structure in a non-random repeating pattern.

Additional information relating to the fibrous structure may be found in U.S. Patent Application No. 2004/0154768, filed by Trokhan et al. and published Aug. 12, 2004, US Patent Application No. 2004/0157524, filed by Polat et al. and published Aug. 12, 2004, U.S. Pat. No. 4,588,457, issued to Crenshaw et al., May 13, 1986, U.S. Pat. No. 5,397,435, issued to Ostendorf et al., Mar. 14, 1995 and U.S. Pat. No. 5,405,501, issued to Phan et al., Apr. 11, 1995.

Substrate

The molded fibrous structure, as described above, may be utilized to form a substrate. The molded fibrous structure may continue to be processed in any method to convert the molded fibrous structure to a substrate having at least one molded element. This may include, but is not limited to, slitting, cutting, perforating, folding, stacking, interleaving, lotioning and combinations thereof.

The material from which a substrate is made should be strong enough to resist tearing during manufacture and normal use, yet still provide softness to the user's skin, such as a child's tender skin. Additionally, the material should be at least capable of retaining its form for the duration of the user's cleansing experience.

Substrates may be generally of sufficient dimension to allow for convenient handling. Typically, the substrate may be cut and/or folded to such dimensions as part of the manufacturing process. The substrate may be cut into individual portions so as to provide separate wipes which are often stacked and interleaved in consumer packaging. Suitably, the separate wipes may have a length between about 100 mm and about 250 mm and a width between about 140 mm and about 250 mm. In one embodiment, the separate wipe may be about 200 mm long and about 180 mm wide.

The material of the substrate may generally be soft and flexible, potentially having a structured surface to enhance its performance. The substrate may include laminates of two or more materials. Commercially available laminates, or purposely built laminates are contemplated. The laminated materials may be joined or bonded together in any suitable fashion, such as, but not limited to, ultrasonic bonding, adhesive, glue, fusion bonding, heat bonding, thermal bonding, hydroentangling and combinations thereof. In another alternative embodiment the substrate may be a laminate comprising one or more layers of nonwoven materials and one or more layers of film. Examples of such optional films, include, but are not limited to, polyolefin films, such as, polyethylene film. An illustrative, but non-limiting example of a nonwoven sheet member which is a laminate of a 16 gsm nonwoven polypropylene and a 0.8 mm 20 gsm polyethylene film.

The substrate materials may also be treated to improve the softness and texture thereof. The substrate may be subjected to various treatments, such as, but not limited to, physical treatment, such as ring rolling, as described in U.S. Pat. No. 5,143,679; structural elongation, as described in U.S. Pat. No. 5,518,801; consolidation, as described in U.S. Pat. Nos. 5,914,084, 6,114,263, 6,129,801 and 6,383,431; stretch aperturing, as described in U.S. Pat. Nos. 5,628,097, 5,658,639 and 5,916,661; differential elongation, as described in WO Publication No. 2003/0028165A1; and other solid state formation technologies as described in U.S. Publication No. 2004/0131820A1 and U.S. Publication No. 2004/0265534A1, zone activation, and the like; chemical treatment, such as, but not limited to, rendering part or all of the substrate hydrophobic, and/or hydrophilic, and the like; thermal treatment, such as, but not limited to, softening of fibers by heating, thermal bonding and the like; and combinations thereof.

The substrate may have a basis weight of at least about 30 grams/$m^2$. The substrate may have a basis weight of at least about 40 grams/$m^2$. In one embodiment, the substrate may have a basis weight of at least about 45 grams/$m^2$. In another embodiment, the substrate basis weight may be less than about 75 grams/$m^2$. In another embodiment, substrates may have a basis weight between about 40 grams/$m^2$ and about 75 grams/$m^2$, and in yet another embodiment a basis weight between about 40 grams/$m^2$ and about 65 grams/$m^2$. The substrate may have a basis weight between about 30, 40, or 45 and about 50, 55, 60, 65, 70 or 75 grams/$m^2$.

A suitable substrate may be a carded nonwoven comprising a 40/60 blend of viscose fibers and polypropylene fibers having a basis weight of 58 grams/$m^2$ as available from Suominen of Tampere, Finland as FIBRELLA 3160. Another suitable material for use as a substrate may be SAWATEX 2642 as available from Sandler AG of Schwarzenbach/Salle, Germany. Yet another suitable material for use as a substrate may have a basis weight of from about 50 grams/$m^2$ to about 60 grams/$m^2$ and have a 20/80 blend of viscose fibers and polypropylene fibers. The substrate may also be a 60/40 blend of pulp and viscose fibers. The substrate may also be formed from any of the following fibrous webs such as those available from the J.W. Suominen Company of Finland, and sold under the FIBRELLA trade name. For example, FIBRELLA 3100 is a 62 gsm nonwoven web comprising 50% 1.5 denier polypropylene fibers and 50% 1.5 denier viscose fibers. In both of these commercially available fibrous webs, the average fiber length is about 38 mm. Additional fibrous webs available from Suominen may include a 62 gsm nonwoven web comprising 60% polypropylene fibers and 40% viscose fibers; a fibrous web comprising a basis weight from about 50 or 55 to about 58 or 62 and comprising 60% polypropylene fibers and 40% viscose fibers; and a fibrous web comprising a basis weight from about 62 to about 70 or 75 gsm. The latter fibrous web may comprise 60% polypropylene fibers and 40% viscose fibers.

Soothing and/or Cleansing Composition

The substrate may further include a soothing and/or cleansing composition. The composition impregnating the substrate is commonly and interchangeably called lotion, soothing lotion, soothing composition, oil-in-water emulsion composition, emulsion composition, emulsion, cleaning or cleansing lotion or composition. All those terms are hereby used interchangeably. The composition may generally comprise the following optional ingredients: emollients, surfactants and/or an emulsifiers, soothing agents, rheology modifiers, preservatives, or more specifically a combination of preservative compounds acting together as a preservative system and water.

It is to be noted that some compounds can have a multiple function and that all compounds are not necessarily present in the composition of the invention. The composition may be a oil-in-water emulsion. The pH of the composition may be from about pH 3, 4 or 5 to about pH7, 7.5, or 9.

Emollient

In some embodiments of the substrates, emollients may (1) improve the glide of the substrate on the skin, by enhancing the lubrication and thus decreasing the abrasion of the skin, (2) hydrate the residues (for example, fecal residues or dried urine residues), thus enhancing their removal from the skin, (3) hydrate the skin, thus reducing its dryness and irritation while improving its flexibility under the wiping movement, and (4) protect the skin from later irritation (for example, caused by the friction of underwear) as the emollient is deposited onto the skin and remains at its surface as a thin protective layer.

In one embodiment, emollients may be silicone based. Silicone-based emollients may be organo-silicone based polymers with repeating siloxane (Si—O) units. Silicone-based emollients of substrate embodiments may be hydrophobic and may exist in a wide range of possible molecular weights. They may include linear, cyclic and cross-linked varieties. Silicone oils may be chemically inert and may have a high flash point. Due to their low surface tension, silicone oils may be easily spreadable and may have high surface activity. Examples of silicon oil may include: cyclomethicones, dimethicones, phenyl-modified silicones, alkyl-modified silicones, silicones resins and combinations thereof.

Other useful emollients can be unsaturated esters or fatty esters. Examples of unsaturated esters or fatty esters of embodiments include: caprylic capric triglycerides in combination with Bis-PEG/PPG-16/16 PEG/PPG-16/16 dimethicone and C12-C15 alkylbenzoate and combinations thereof.

The amount of emollient that can be included in the lotion composition will depend on a variety of factors, including the particular emollient involved, the lotion-like benefits desired, and the other components in the lotion composition. It has been found that compositions with low or very low emollient content are best suited. The emollient content of the composition is from about 0.001% to less than about 5%, from about 0.001% to less than about 3%, from about 0.001% to less than about 2.5% and from about 0.001% to less than about 1.5% (all % are weight/weight % of the emollient in the composition).

A relatively low surface tension may act more efficiently in the composition. Surface tension lower than about 35 mN/m, or even lower than about 25 mN/m. In certain embodiments, the emollient may have a medium to low polarity. Also, the emollient of an embodiment may have a solubility parameter between about 5 and about 12, or even between about 5 and about 9. The basic reference of the evaluation of surface tension, polarity, viscosity and spreadability of emollient can be found under Dietz, T., Basic properties of cosmetic oils and their relevance to emulsion preparations. SÖFW-Journal, July 1999, pages 1-7.

Emulsifier/Surfactant

The composition may also include an emulsifier such as those forming oil-in-water emulsions. The emulsifier can be a mixture of chemical compounds and include surfactants. The preferred emulsifiers are those acting as well as a surfactant. For the purpose of this document, the terms emulsifiers and surfactants are thereafter used interchangeably. The emulsifier may be a polymeric emulsifier or a non polymeric one.

The emulsifier may be employed in an amount effective to emulsify the emollient and/or any other non-water-soluble oils that may be present in the composition, such as an amount ranging from about 0.5%, 1%, or 4% to about 0.001%, 0.01%, or 0.02% (based on the weight emulsifiers over the weight of the composition). Mixtures of emulsifiers may be used.

Emulsifiers for use in some embodiments may be selected from the group of alkylpolylglucosides, decylpolyglucoside, fatty alcohol or alkoxylated fatty alcohol phosphate esters (e.g., trilaureth-4 phosphate), sodium trideceth-3 carboxylate, or a mixture of caprylic capric triglyceride and Bis-PEG/PPG-16/16 PEG/PPG-16/16 dimethicone, polysorbate 20, and combinations thereof.

Rheology Modifier

Rheology modifiers are compounds that increase the viscosity of the composition at lower temperatures as well as at process temperatures. Each of these materials may also provide "structure" to the compositions to prevent settling out (separation) of insoluble and partially soluble components. Other components or additives of the compositions may affect the temperature viscosity/rheology of the compositions.

In addition to stabilizing the suspension of insoluble and partially soluble components, the rheology modifiers of the invention may also help to stabilize the composition on the substrate and enhance the transfer of lotion to the skin. The wiping movement may increase the shear and pressure therefore decreasing the viscosity of the lotion and enabling a better transfer to the skin as well as a better lubrication effect.

Additionally, the rheology modifier may help to preserve a homogeneous distribution of the composition within a stack of substrates. Any composition that is in fluid form has a tendency to migrate to the lower part of the wipes stack during prolonged storage. This effect creates an upper zone of the stack having less composition than the bottom part.

Preferred rheology modifiers may exhibit low initial viscosity and high yield. Particularly suited are rheology modifiers such as, but not limited to:

- Blends of material as are available from Uniqema GmbH&Co. KG, of Emmerich, Germany under the trade name ARLATONE. For instance, ARLATONE V-175 which is a blend of sucrose palmitate, glyceryl stearate, glyceryl stearate citrate, sucrose, mannan, and xanthan gum and Arlatone V-100 which is a blend of steareth-100, steareth-2, glyceryl stearate citrate, sucrose, mannan and xanthan gum.
- Blends of materials as are available from Seppic France of Paris, France as SIMULGEL. For example, SIMULGEL NS which comprises a blend of hydroxyethylacrylate/sodium acryloyldimethyl taurate copolymer and squalane and polysorbate 60, sodium acrylate/sodium acryloyldimethyltaurate copolymer and polyisobutene and caprylyl capryl glucoside, acrylate copolymers, such as but not limited to acrylates/acrylamide copolymers, mineral oil, and polysorbate 85.
- Acrylate homopolymers, acrylate crosspolymers, such as but not limited to, Acrylate/C10-30 Alkyl Acrylate crosspolymers, carbomers, such as but not limited to acrylic acid cross linked with one or more allyl ether, such as but not limited to allyl ethers of pentaerythritol, allyl ethers of sucrose, allyl ethers of propylene, and combinations thereof as are available are available as the Carbopol® 900 series from Noveon, Inc. of Cleveland, Ohio (e.g., Carbopol® 954).
- Naturally occurring polymers such as xanthan gum, galactoarabinan and other polysaccharides.
- Combinations of the above rheology modifiers.

Examples, of commercially available rheology modifiers include but are not limited to, Ultrez-10, a carbomer, and Pemulen TR-2, acrylate crosspolymers, both of which are available from Noveon, Cleveland Ohio, and Keltrol, a xanthan gum, available from CP Kelco San Diego Calif.

Rheology modifiers imparting a low viscosity may be used. Low viscosity is understood to mean viscosity of less than about 10,000 cps at about 25 degrees Celsius of a 1% aqueous solution. The viscosity may be less than about 5,000 cps under the same conditions. Further, the viscosity may be less than about 2000 cps or even less than about 1,000 cps. Other characteristics of emulsifiers may include high polarity and a non-ionic nature.

Rheology modifiers, when present may be used at a weight/weight % (w/w) from about 0.01%, 0.015%, or 0.02% to about 1%, 2%, or 3%.

Preservative

The need to control microbiological growth in personal care products is known to be particularly acute in water based products such as oil-in-water emulsions and in pre-impregnated substrates such as baby wipes. The composition may comprise a preservative or a combination of preservatives acting together as a preservative system. Preservatives and preservative systems are used interchangeably in the present document to indicate one unique or a combination of preservative compounds. A preservative is understood to be a chemical or natural compound or a combination of compounds reducing the growth of microorganisms, thus enabling a longer shelf life for the pack of wipes (opened or not opened) as well as creating an environment with reduced growth of microorganisms when transferred to the skin during the wiping process.

Preservatives of certain embodiments can be defined by 2 key characteristics: (i) activity against a large spectrum of microorganisms, that may include bacteria and/or molds and/or yeast, or all three categories of microorganisms together and (2) killing efficacy and/or the efficacy to reduce the growth rate at a concentration as low as possible.

The spectrum of activity of the preservative of embodiments may include bacteria, molds and yeast. Ideally, each of such microorganisms are killed by the preservative. Another mode of action to be contemplated is the reduction of the growth rate of the microorganisms without active killing. Both actions however result in a drastic reduction of the population of microorganisms.

Suitable materials include, but are not limited to a methylol compound, or its equivalent, an iodopropynyl compound and mixtures thereof. Methylol compounds release a low level of formaldehyde when in water solution that has effective preservative activity. Exemplary methylol compounds include but are not limited to: diazolidinyl urea (GERMALL® II as is available from International Specialty Products of Wayne, N.J.) N-[1,3-bis(hydroxy-methyl)-2,5-dioxo-4-imidazolidinyl]-N,N'-bis(hydroxymethyl) urea, imidurea (GERMALL® 115 as is available from International Specialty Products of Wayne, N.J.), 1,1-methylene bis[3-[3-(hydroxymethyl)-2,5-dioxo-4-imidazolidinyl]urea]; 1,3-dimethylol-5,5-dimethyl hydantoin (DMDMH), sodium hydroxymethyl glycinate (SUTTOCIDE® A as is available from International Specialty Products of Wayne, N.J.), and glycine anhydride dimethylol (GADM). Methylol compounds can be effectively used at concentrations (100% active basis) between about 0.025% and about 0.50%. A preferred concentration (100% basis) is about 0.075%. The iodopropynyl compound provides antifungal activity. An exemplary material is iodopropynyl butyl carbamate as is available from Clariant UK, Ltd. of Leeds, The United Kingdom as NIPACIDE IPBC. A particularly preferred material is 3-iodo-2-propynylbutylcarbamate. Iodopropynyl compounds can be used effectively at a concentration between about 0% and about 0.05%. A preferred concentration is about 0.009%. A particularly preferred preservative system of this type comprise a blend of a methylol compound at a concentration of about 0.075% and a iodopropynyl compound at a concentration of about 0.009%.

In another embodiment, the preservative system may comprise simple aromatic alcohols (e.g., benzyl alcohol). Materials of this type have effective anti bacterial activity. Benzyl alcohol is available from Symrise, Inc. of Teterboro, N.J.

In another embodiment, the preservative may be a paraben antimicrobial selected from the group consisting of methylparaben, ethylparaben, propylparaben, butylparaben, isobutylparaben or combinations thereof.

In another embodiment, the preservative may be a low-pH acid and/or buffer-system to maintain a pH less than about 4.5.

Chelators (e.g., ethylenediamine tetraacetic acid and its salts) may also be used in preservative systems as a potentiator for other preservative ingredients.

The preservative composition can also provide a broad anti-microbial effect without the use of formaldehyde donor derived products.

Optional Components of the Composition

The composition may optionally include adjunct ingredients. Possible adjunct ingredients may be selected from a wide range of additional ingredients such as, but not limited to soothing agents, perfumes and fragrances, texturizers, colorants, and medically active ingredients, in particular healing actives and skin protectants.

Soothing agents are compounds having the ability to reduce the irritation or stinging/burning/itching effect of some chemicals. Soothing agents can be of a variety of chemical classes. Soothing agents can have a variety of modes of action to neutralize the effects of the skin irritants, especially for paraben based preservative systems. For example antioxidants can be soothing agents for oxidants. Buffers can be soothing agents neutralizing the stinging effect on skin of acids or bases. It is to be noted that emollients can also be soothing agents. Soothing agents that act against the stinging/irritation effect of some preservatives are preferred. Those soothing agents can be emollients or surfactants helping, for example, the solubilization or the micellization of the preservatives.

Optional soothing agents may be (a) ethoxylated surface active compounds, those having an ethoxylation number below about 60, (b) polymers, polyvinylpyrrolidone (PVP) and/or N-vinylcaprolactam homopolymer (PVC), and (c) phospholipids, phospholipids complexed with other functional ingredients as e.g., fatty acids, organosilicones.

The soothing agents may be selected from the group comprising PEG-40 hydrogenated castor oil, sorbitan isostearate, isoceteth-20, sorbeth-30, sorbitan monooleate, coceth-7, PPG-1-PEG-9 lauryl glycol ether, PEG-45 palm kernel glycerides, PEG-20 almond glycerides, PEG-7 hydrogenated castor oil, PEG-50 hydrogenated castor oil, PEG-30 castor oil, PEG-24 hydrogenated lanolin, PEG-20 hydrogenated lanolin, PEG-6 caprylic/capric glycerides, PPG-1 PEG-9 lauryl glycol ether, lauryl glucoside polyglyceryl-2 dipolyhydroxystearate, sodium glutamate, polyvinylpyrrolidone, N-vinylcaprolactam homopolymer, sodium coco PG-dimonium chloride phosphate, linoleamidopropyl PG-dimonium chloride phosphate, dodium borageamidopropyl PG-dimonium chloride phosphate, N-linoleamidopropyl PG-dimonium chloride phosphate dimethicone, cocamidopropyl PG-dimonium chloride phosphate, stearamidopropyl PG-dimonium chloride phosphate and stearamidopropyl PG-dimonium chloride phosphate (and) cetyl alcohol, and combinations thereof. A particularly preferred soothing agent is PEG-40 hydrogenated castor oil as is available from BASF of Ludwigshafen, Germany as Cremophor CO 40.

Representative examples of lotion composition useful in embodiments are given as Examples A-D below.

Example A

| Component | Amount (% by weight) |
|---|---|
| (1) Disodium EDTA | 0.10 |
| (2) Arlatone-V 175 ™* | 0.80 |
| (3) Decylglycoside | 0.05 |
| (4) Cyclopentasiloxane Dimethiconol | 0.45 |
| (5) 1,2-Propyleneglycol | 1.50 |
| (6) Phenoxyethanol | 0.80 |
| (7) Methylparaben | 0.15 |
| (8) Propylparaben | 0.05 |
| (9) Ethylparaben | 0.05 |
| (10) PEG-40 Hydrogenated Castor Oil | 0.80 |
| (11) Perfume | 0.05 |
| (12) Purified water | Balance |
| Total | 100 |

*Arlatone-V 175 ™ comprises sucrose palmitate, glyceryl stearate, glyceryl stearate citrate, sucrose, mannan, xanthan gum and is commercialized by Uniqema GmbH&Co. KG 46429 Emmerich, Germany, www.uniqema.com.

Example B

| Component | Amount (% by weight) |
|---|---|
| (1) Disodium EDTA | 0.10 |
| (2) Arlatone-V 175 ™* | 0.80 |
| (3) Abil Care 85 ™** | 0.45 |
| (4) Decylglycoside | 0.05 |
| (5) 1,2-Propyleneglycol | 1.50 |
| (6) Sodium benzoate | 0.20 |
| (7) Methylparaben | 0.15 |
| (8) Propylparaben | 0.05 |
| (9) Ethylparaben | 0.05 |
| (10) PEG-40 Hydrogenated Castor Oil | 0.80 |
| (11) Perfume | 0.05 |
| (12) Purified water | Balance |
| Total | 100.00 |

*Arlatone-V 175 ™ comprises sucrose palmitate, glyceryl stearate, glyceryl stearate citrate, sucrose, mannan, xanthan gum and is commercialized by Uniqema GmbH&Co. KG, 46429 Emmerich, Germany, www.uniqema.com.

**Abil Care 85 ™ comprises Bis-PEG/PPG-16/16 PEG/PPG Dimethicone Caprylic Capric triglyceride and is commercialized by Goldschmidt/Degussa, Goldschmidt AG, 45127 Essen, Germany www.goldschmidt.com.

Example C

| Component | Amount (% by weight) |
|---|---|
| (1) Disodium EDTA | 0.10 |
| (2) Xanthan Gum | 0.18 |
| (3) Abil Care 85 ™** | 0.10 |
| (4) 1,2-Propyleneglycol | 1.50 |
| (5) Phenoxyethanol | 0.60 |
| (6) Methylparaben | 0.15 |
| (7) Propylparaben | 0.05 |
| (8) Ethylparaben | 0.05 |
| (9) Trilaureth-4 Phosphate | 0.40 |
| (10) PEG-40 Hydrogenated Castor Oil | 0.40 |
| (11) Perfume | 0.07 |
| (12) Purified water | Balance |
| Total | 100.00 |

**Abil Care 85 ™ comprises Bis-PEG/PPG-16/16 PEG/PPG Dimethicone Caprylic Capric triglyceride and is commercialized by Goldschmidt/Degussa, Goldschmidt AG, 45127 Essen, Germany www.goldschmidt.com.

Example D

| Component | Amount (% by weight) |
|---|---|
| (1) Disodium EDTA | 0.10 |
| (2) Xanthan Gum | 0.18 |
| (3) Abil Care 85 ™** | 0.10 |
| (4) Sodium Benzoate | 0.12 |
| (5) Citric Acid | 0.53 |
| (6) Sodium Citrate | 0.39 |
| (7) Benzyl Alcohol | 0.30 |
| (8) Euxyl PE9010*** | 0.30 |
| (10) PEG-40 Hydrogenated Castor Oil | 0.44 |
| (11) Perfume | 0.07 |
| (12) Purified water | Balance |
| Total | 100 |

**Abil Care 85 ™ comprises Bis-PEG/PPG-16/16 PEG/PPG Dimethicone Caprylic Capric triglyceride and is commercialized by Goldschmidt/Degussa, Goldschmidt AG, 45127 Essen, Germany www.goldschmidt.com.
***Euxyl PE9010 tm comprises a mixture of phenoxyethanol and ethylhexylglycerin and is commercialized by Schulke & Mayr GmbH, Germany.

Method of Making Molded Fibrous Structure

Generally, the process for making a fibrous structure may be described in terms of initially forming a fibrous web having a plurality of synthetic fibers, a plurality of natural fibers, or a combination thereof. Layered deposition of the fibers, synthetic and natural, are also contemplated. In an embodiment, the fibrous web can be formed in any fashion and may be any nonwoven web suitable for use in a hydromolding process. The fibrous web may consist of any web, mat, or batt of loose fibers disposed in any relationship with one another in any degree of alignment, such as might be produced by carding, air-laying, spunmelting (including meltblowing and spunlaying), coforming and the like.

In an embodiment, a fibrous web may be produced by conducting the carding, spunmelting, spunlaying, meltblowing, coforming, or air-laying or other bonding processes concurrently with the fibers contacting a forming member. In addition, the process may involve subjecting the fibrous web to a hydroentanglement process while the fibrous web is in contact with the forming member. The hydroentanglement process (also known as spunlacing or spunbonding) is a known process of producing nonwoven webs, and involves laying down a matrix of fibers, for example as a carded web or an air-laid web, and entangling the fibers to form a coherent web. Entangling is typically accomplished by impinging the matrix of fibers with high pressure liquid (typically water) from one or more suitably-placed water jets. The pressure of the liquid jets, as well as the orifice size and the energy imparted to the fibrous structure by the water jets, may be the same as those of a conventional hydroentangling process. Typical entanglement energy is about 0.1 kwh/kg. Optionally, other fluids can be used as the impinging medium, such as compressed air. The fibers of the web are entangled, but not physically bonded one to another. The fibers of a hydroentangled web, therefore, have more freedom of movement than fibers of webs formed by thermal or chemical bonding. Particularly when lubricated by wetting, as in a pre-moistened wet wipe, such spunlaced webs provide webs having very low bending torques and low moduli, thereby providing softness and suppleness.

Additional information on hydroentanglement can be found in U.S. Pat. No. 3,485,706 issued on Dec. 23, 1969, to Evans; U.S. Pat. No. 3,800,364 issued on Apr. 2, 1974, to Kalwaites; U.S. Pat. No. 3,917,785 issued on Nov. 4, 1975, to Kalwaites; U.S. Pat. No. 4,379,799 issued on Apr. 12, 1983, to Holmes; U.S. Pat. No. 4,665,597 issued on May 19, 1987, to Suzuki; U.S. Pat. No. 4,718,152 issued on Jan. 12, 1988, to Suzuki; U.S. Pat. No. 4,868,958 issued on Sep. 26, 1989, to Suzuki; U.S. Pat. No. 5,115,544 issued on May 26, 1992, to Widen; and U.S. Pat. No. 6,361,784 issued on Mar. 26, 2002, to Brennan.

After the fibrous web has been formed, it can be subjected to additional process steps, such as, for example, hydromolding (also known as molding, hydro-embossing, hydraulic needle-punching, etc.). FIG. 1 illustrates a side view of a hydromolding process 100. Hydromolding process 100 includes, molding member 110, fibrous web 130 being conveyed over the top of the molding member 110. A single jet 140, or multiple jets (not shown), may be utilized. Water or any other appropriate fluid medium may be ejected from the jet 140 to impact the fibrous web 130. The fluid may impact the fibrous web in a continuous flow or non-continuous flow. The molding member 110 may include a molding pattern (not shown). The molding pattern may include raised areas, lowered areas, and combinations thereof. As the fluid from the jet(s) 140 impacts the fibrous web 130, the fibrous web 30 conforms to the molding pattern (not shown) on molding member 110. The fluid may "push" portions of the fibrous web 130 into lowered areas of the pattern. The result is a molded fibrous structure 136 having a mirror image of the pattern, if any, on the molding member 110.

The resulting molded fibrous structure 136 may be processed in any method to covert the molded fibrous structure 136 to a substrate suitable for use as a wipe. This may include, but is not limited to, slitting, cutting, perforating, folding, stacking, interleaving, lotioning and combinations thereof.

By hydromolding the fibrous web 130 into a fibrous structure 136, it can gain additional aesthetics making the fibrous structure particularly suitable and pleasing for use as a wipe. Hydromolding, as may be applied to substrates useful as wipes, which may include a number of decorative patterns. Such patterns may include regular arrays of small geometric shapes (such as, for example, circles, squares, rectangles, ovals, triangles, octagons, tear drops, droplets, etc.) regular repeating patterns of lines, and curves, images of animals, etc.

Other beneficial physical characteristics may be imparted to the fibrous web by hydromolding. Specifically, hydromolding a fibrous web my have an effect on the interfacial pore size distribution occurring between adjacent wipes in a stack of wet wipes, and thereby may have an effect on the dispensing forces for individual wipes when dispensed from a package.

Non-Woven Substrate

Figure 2:
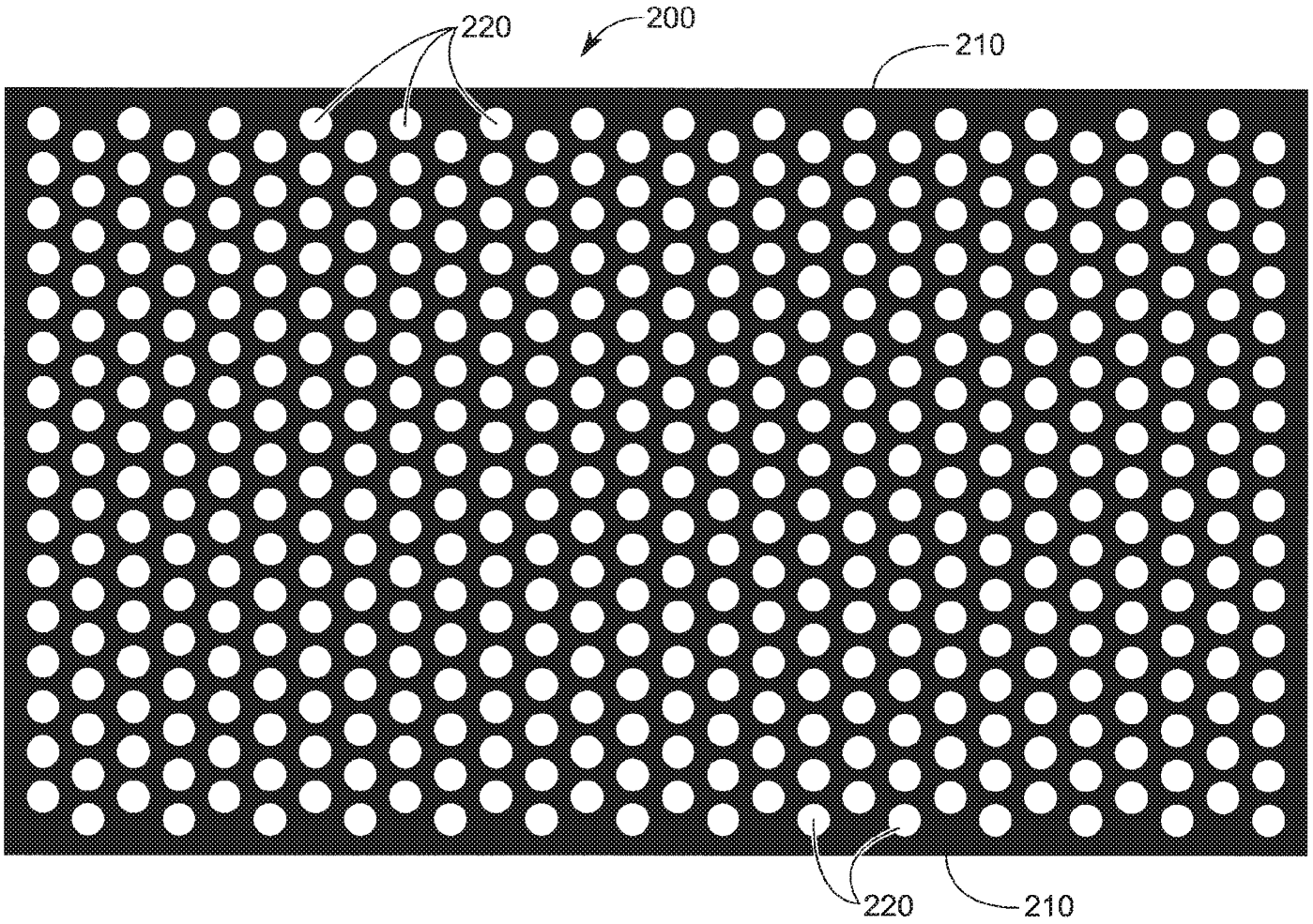
FIG. 2 is a substrate having a molded pattern that exhibits a higher interfacial pore size than the prior art substrate illustrated in FIG. 3.

FIG. 2 illustrates an exemplary substrate 200 having a high interfacial pore size and reduced interfacial contact area. Substrate 200 is formed from a nonwoven material. Substrate 200 includes a pattern. The pattern contains a raised portion 210 and a plurality of recessed portions 220. In this exemplary embodiment, raised portion 120 is substantially continuous in the X-Y plane. Recessed portions 220 are substantially circular and approximately 3 mm-5 mm in diameter and separated from one another by about 1 mm-2 mm. In this exemplary embodiment, recessed portions 220 are discrete and separate from one another. Other geometric shapes for recessed portions 220, such as tear drop shapes, triangles, squares, ovals, etc. are contemplated. Recessed portions 220 are arranged in columns. Other geometric arrangements of the shapes are also contemplated, such as, for example, arrangements that creating a graphic image. The raised portion 210 is approximately 50% of the surface area of substrate 200. In addition, the density of the raised portion 210 may be greater than the density of the recessed portion 220. Substrate 200 exhibits a higher average interfacial pore-size (e.g. effective average radius of the capillaries) than the prior art substrate 300 (illustrated in FIG. 3). The higher average interfacial pore-size reduces the interfacial capillary pressure between adjacent wipes and reduces the force required to separate adjacent wipes ("separation force"). In addition, substrate 200 has a reduced interfacial contact area between adjacent wipes when compared to substrate 300, which also reduces the separation force.

Figure 3:
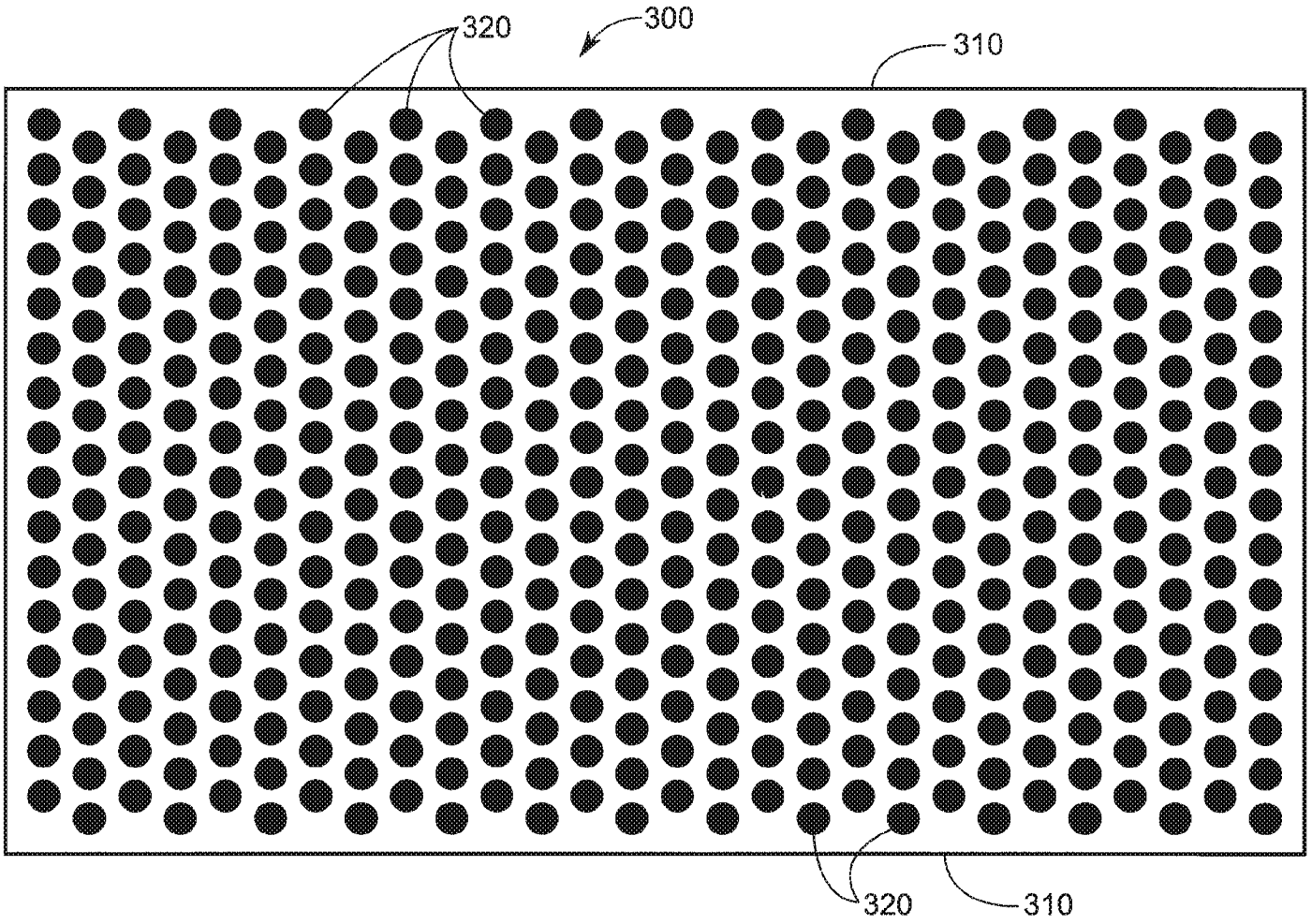
FIG. 3 is a prior art substrate that exhibits a lower interfacial pore size than the substrate illustrated in FIG. 2.

FIG. 3 illustrates a prior art substrate 300 which is a mirror image of substrate 200. Substrate 300 is formed from a nonwoven material. Substrate 300 includes a pattern on one side. The pattern contains a recessed portion 310 and a plurality of raised portions 320. Recessed portion 310 is substantially continuous in the X-Y plane, and comprises approximately 50% of the surface area. Raised portions 320 are substantially circular and approximately 3 mm-5 mm in diameter and separated from one another by about 1 mm-2 mm. Raised portions 320 are discrete. Surprisingly, prior art substrate 300 has a lower average interfacial pore-size than substrate 200 when packaged with other substrate having the same pattern. In addition, substrate 300 has a greater interfacial contact area.

Accordingly, beneficial physical characteristics are imparted to the substrate 200 via the molding pattern. Specifically, the molded pattern on substrate 200 increases the average interfacial pore-size and reduces the interfacial capillary pressure occurring between adjacent wipes in a package of wet wipes as a result. A reduction in interfacial capillary pressure reduces the dispensing forces between adjacent wipes when dispensed from a package. In addition, the molded pattern substrate reduces the interfacial contact area.

Additional benefits of substrates made in accordance with the methods disclosed herein may include greater clarity in the embossed pattern, and a thicker appearance.

Without being bound by theory it is believed that efficient dispensing of wipes relies on a number of forces. Non-limiting examples of such forces include: the wipe-to-wipe separation force; the wipe-to-orifice frictional force; the gravitational force on the package as a whole; the pull-force exerted by the user, and so forth. Different dispensing configurations (i.e. flat-pack or non-interleaved, perforated roll, etc.) have different efficiencies that will also affect relevant dispensing forces, though the relevant forces for the different dispensing configurations may be different from the relevant forces for the pop-up or interleaved configuration. Without being bound by theory it is believed that the wipe-to-wipe separation force is a relevant dispensing force for all wipes dispensing configurations.

Without being bound by theory it is believed that the wipe-to-wipe separation force is a function of the wipe-to-wipe contact-area and the wipe-to-wipe interfacial capillary pressure. The interfacial pressure is a measure of the degree to which adjacent wipes adhere to one-another in the wet-state due to the capillary forces exerted by each wipe on the interstitial fluid there-between and on the fluid contained within the adjacent wipe.

LaPlace Relationship teaches that capillary pressure is inversely proportional to pore-size.

$$P \propto I/R$$

Where P is the capillary pressure and R the effective radius of the pore. As such is it further believed that increasing the average interfacial pore-size results in a decrease in the interfacial pressure. It is further believed that hydromolding can affect the capillary void structure of the substrate, thereby affecting the average interfacial pore-size and the interfacial pressure. Hydromolding may increase the interfacial capillary pressure or decrease the interfacial capillary pressure.

Contact Area

Without being bound by theory it is also believed that wipe-to-wipe separation force is also a function of wipe-to-wipe contact-area. Wipe-to-wipe contact area may consist of at least two important components: Area of overlap and "nesting."

Figure 5:
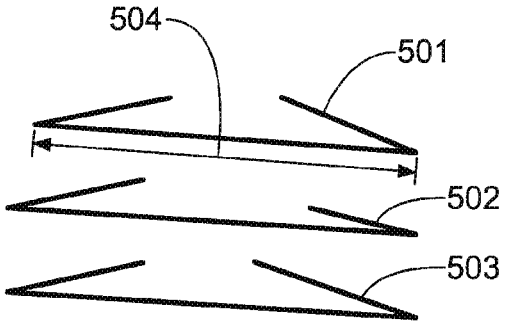
FIG. 5 illustrates the interfacial contact area between wipes packaged in a non-interleaved manner.

Area of overlap refers to the total surface area over which adjacent wipes contact one-another, in the wipe stack, during the act of dispensing. For example, in flat-pack or non-interleaved dispensing configuration the area-of-overlap consists of the surface area of the wipe in its folded state, wherein the wipe being dispensed is in full contact with the adjacent wipe in the stack at the time of dispensing. FIG. 5 illustrates an exemplary non-interleaved stack. Wipes 501, 502, and 503 are stacked on top of one another. The interfacial contact area is the area-of-overlap and is shown as a cross-sectional view as 504 in FIG. 5.

Figure 6:
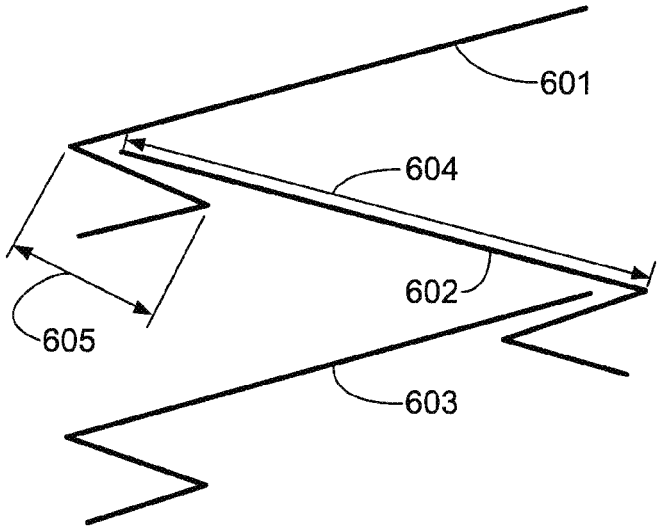
FIG. 6 illustrates the interfacial contact area between wipes packaged in an interleaved manner.

In a pop-up or interleaved dispensing configuration, the area-of-overlap consists of the surface area over which any individual wipe overlaps with the next adjacent wipe in the interleaved folding configuration. FIG. 6 illustrates an interleaved stack of wipes 601, 602 and 603 stacked on top of one another in an interleaved pattern. The areas-of-overlap 604, 605 are also illustrated. The wipe-to-wipe separation force can be manipulated through the use of different folding patterns resulting in different areas-of-overlap between adjacent wipes in the stack. However, changing the areas of overlap may change the stack dimensions and require a change in package size or quantity of wipes per container.

Figure 4A:
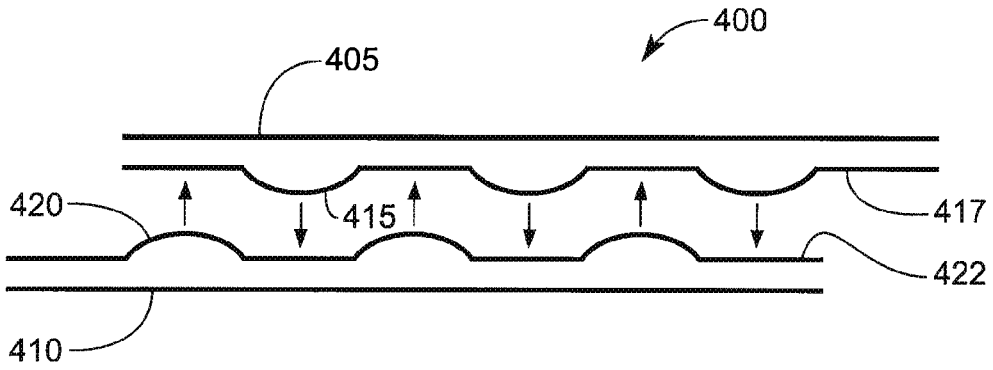
FIG. 4A illustrates substrates having molded patterns that nest.
Figure 4B:
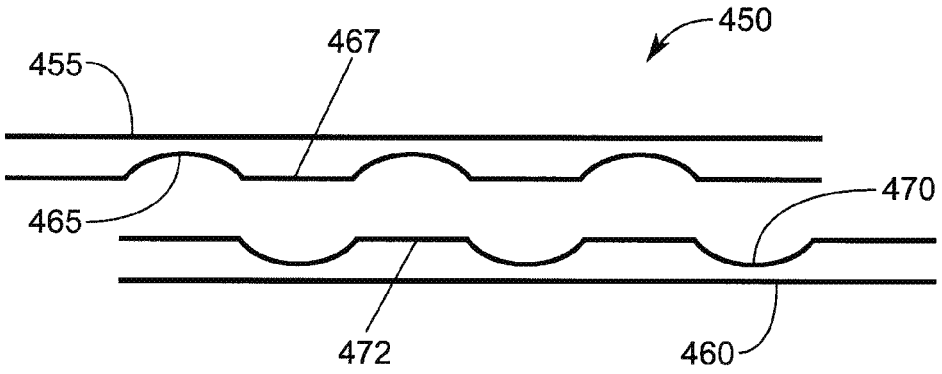
FIG. 4B illustrate substrates having molded patterns that tend not to nest.

Nesting refers to the increased or decreased degree of overlap or interfacial contact area that may result from imparting raised or lowered images to the wipe. Nesting occurs when the raised portion of the image on one wipe embeds into the lowered portion of the image on the adjacent wipe. FIG. 4A illustrates a nesting pattern 400, and FIG. 4B illustrates a second pattern 450 that has little to no nesting. Substrate 405 has raised portions 415 and recessed portions 417. The raised portions 415 are smaller than the recessed portions 417. Similarly, substrate 410, which has the same molding pattern as substrate 405, has raised portions 420 and recessed portions 422. When substrates 405 and 410 are placed in a wipes container and packaged, raised portions 415 of substrate 405 may nest in recessed portions 422 of substrate 410. Similarly, raised portions 420 of substrate 410 may nest in recessed portions 417 of substrate 405. This nesting increases the interfacial contact area.

FIG. 4B illustrates a different pattern 450 with little to no nesting. Substrate 455 has recessed portions 465 and raised portions 467, and substrate 460 includes raised portions 472 and recessed portions 470. When substrates 405 and 410 are placed in a wipes container and packaged, raised portions 467 of substrate 455 do not tend to nest in recessed portions 470 of substrate 460.

Improved wipes, being dispensed from a dispensing configuration of wet wipes, made from, for example, substrate 200 (and substrates 450, 460) have reduced wipe-to-wipe separation force. Reducing the wipe-to-wipe interfacial contact area and consequently overall overlap may be achieved by imparting the wipe with an image that comprises a continuous raised portion, such as portion 472 of substrate 460 (FIG. 4B) to prevent the effects of nesting and to reduce the total wipe-to-wipe interfacial contact area given a constant wipe-to-wipe area-of-overlap.

Higher Average Interfacial Pore-Size

The image of substrate 200, not only results in reduced wipe-to-wipe interfacial contact area, but also results in a decrease in the average interfacial pore-size.

EXAMPLE

Table 1 depicts average interfacial pore-size for substrates 200 and 300 imparted with images as depicted in FIGS. 2 and 3 respectively, which illustrates a decrease in interfacial capillary pressure between adjacent wipes.

TABLE 1

| Molded Image | Raised regions | Lowered regions | Average Interfacial pore-size (radius) |
|---|---|---|---|
| Substrate 200 (FIG. 2) | Continuous | Discontinuous | 311μ |
| Substrate 300 - 1st prior art sample (FIG. 3) | Discontinuous | Continuous | 166μ |
| Substrate 300 - 2nd prior art sample (FIG. 3) | Discontinuous | Continuous | 178μ |

The substrates of the examples of Table 1 comprise a 60/40 blend of polypropylene fibers and viscose fibers and has a basis weight of about 58 gsm. Identical pre-entangled webs were subjected to hydromolding of the images as depicted in FIG. 2 and FIG. 3 with the hydro-molding conditions:

Pilot line speed=15 m/min

Pressure=100 bar (2 pass)

Pre-wet=yes

It may be desirable to have an average interfacial pore-size (radius) of greater than about 180 microns. It may also be desirable to have an average interfacial pore-size (radius) of greater than about 185 microns, greater than about 190 microns, greater than about 200 microns, greater than about 210 microns, greater than about 220 microns, greater than about 230 microns, greater than about 240 microns, greater than about 250 microns, greater than about 260 microns, greater than about 270 microns, greater than about 280 microns, greater than about 290 microns, greater than about 300 microns, greater than about 310 microns, greater than about 350 microns, greater than about 400 microns, greater than about 450 microns, or greater than about 500 microns. However, it may not be desirable to have an average interfacial pore-size (radius) of greater than about 700 microns.

Calculation of Interfacial Pore Size Distribution

Methodology

The Interfacial Pore Size Distribution (PSD) may be determined as the weighted-average pore size of the pore-size distribution of the interface between adjacent substrates. The pore-size distribution (PSD) of the interface between two adjacent substrates may be determined from the pore-size distribution of the two combined substrate layers (e.g. a two-ply PSD measurement) and the pore-size distribution of a single substrate layer (e.g. a single-ply PSD measurement). The pore-size distribution of the interface is the numerical difference between the two-ply pore-size distribution and twice the single-ply pore-size distribution.

$$PSD_{interface}=PSD_{2\text{-}ply\ measurement}-2\times PSD_{1\text{-}ply\ measurement}$$

In a PSD measurement, pore-volume is expressed as a function of pore-size. The PSD, then, gives a measure of the liquid holding capacity of each pore-size in the porous media. The PSD of the interface can be calculated from the PSD of the 1-ply measurement and the PSD of the 2-ply measurement in the following manner. At each pore-size in the PSD of the 2-ply measurement and the corresponding same pore-size in the 1-ply measurement, the pore-volume (PV) of the PSD of that same pore-size of the interface is taken as:

$$PV_{interface}=PV_{2\text{-}ply\ measurement}-2\times PV_{1\text{-}ply\ measurement}$$

The distribution of the pore-volumes of the interface as a function of pore-size is the PSD of the interface.

For example, when determining the PSD in 5 u increments of pore-size, the PV of the interface at 0-5 u pore-size would be:

$$PV_{interface,\ 0\text{-}5\ u}=PV_{2\text{-}ply\ measurement,\ 0\text{-}5\ u}-2\times PV_{1\text{-}ply\ measurement,\ 0\text{-}5\ u}$$

Then the PV of the interface at 5-10 u pore-size would be:

$$PV_{interface,\ 5\text{-}10\ u}=PV_{2\text{-}ply\ measurement,\ 5\text{-}10\ u}-2\times PV_{1\text{-}ply\ measurement,\ 5\text{-}10\ u}$$

And so on, over the range of the PSD measurement. The interfacial PV of each pore-size is then plotted as a function of pore-size to yield the PSD of the interface. PSD measurements are typically done to ~800 u pore size or greater.

Pore Volume Uptake Determination

Pore Size Distribution measurements are made on a TRI/Autoporosimeter (TRI/Princeton Inc. of Princeton, N.J.) The TRI/Autoporosimeter is an automated computer-controlled instrument for measuring pore volume uptake and pore-size distribution in porous materials (e.g., the volumes of different size pores within the range from 1 to 900 μm effective pore radii). Complimentary Automated Instrument Software, Release 2003.1/2005.1, and Data Treatment Software, Release 2002.1 is used to capture, analyze and output the data. More information on the TRI/Autoporosimeter, its operation and data treatments can be found in The Journal of Colloid and Interface Science 162 (1994), pgs 163-170, incorporated here by reference.

Determining Pore Volume Uptake or Pore-Size Distribution involves recording the increment of liquid that enters or leaves a porous material as the surrounding air pressure changes. A sample in the test chamber is exposed to precisely controlled changes in air pressure. As the air pressure increases or decreases, the void spaces or pores of the porous media de-water or uptake fluid, respectively.

Total fluid uptake is determined as the total volume of fluid absorbed by the porous media.

Pore-Size Distribution can further be determined as the distribution of the volume of uptake of each pore-size group, as measured by the instrument at the corresponding pressure. The pore size is taken as the effective radius of a pore and is related to the pressure differential by the following relationship.

$$\text{Pressure differential}=[(2)\gamma \cos \Theta)]/\text{effective radius}$$

where $\gamma$=liquid surface tension, and $\Theta$=contact angle.

The automated equipment operates by changing the test chamber air pressure in user-specified increments, either by decreasing pressure (increasing pore size) to cause fluid uptake by the porous media, or by increasing pressure (decreasing pore size) to de-water the porous media. The liquid volume absorbed (drained) at each pressure increment yields the pore size distribution. The fluid uptake is the cumulative volume for all pores taken up by the porous media, which may progress to saturation (e.g. all pores) of the porous media.

Figure 7:
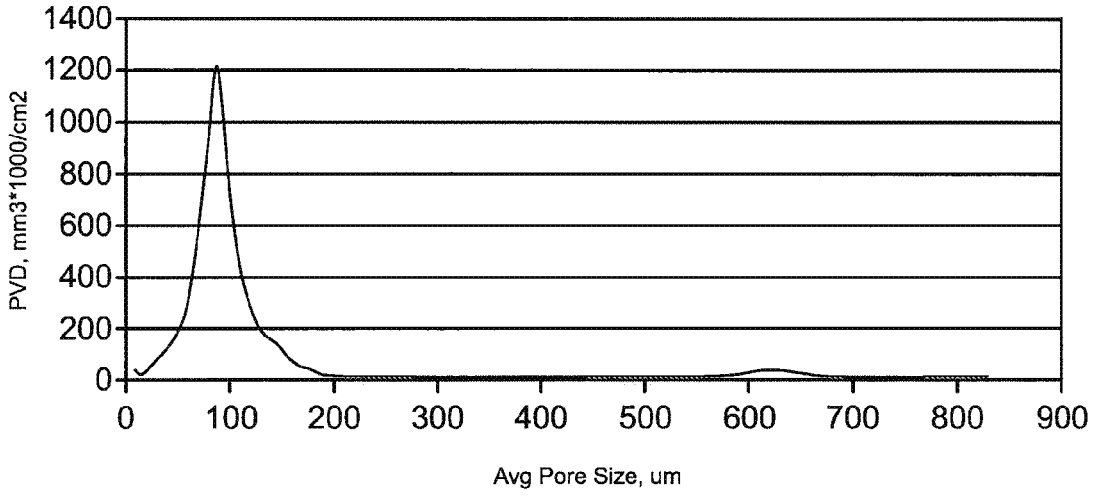
FIG. 7 illustrates a representative Pore Size Distribution for the prior art substrate illustrated in FIG. 3.
Figure 8A:
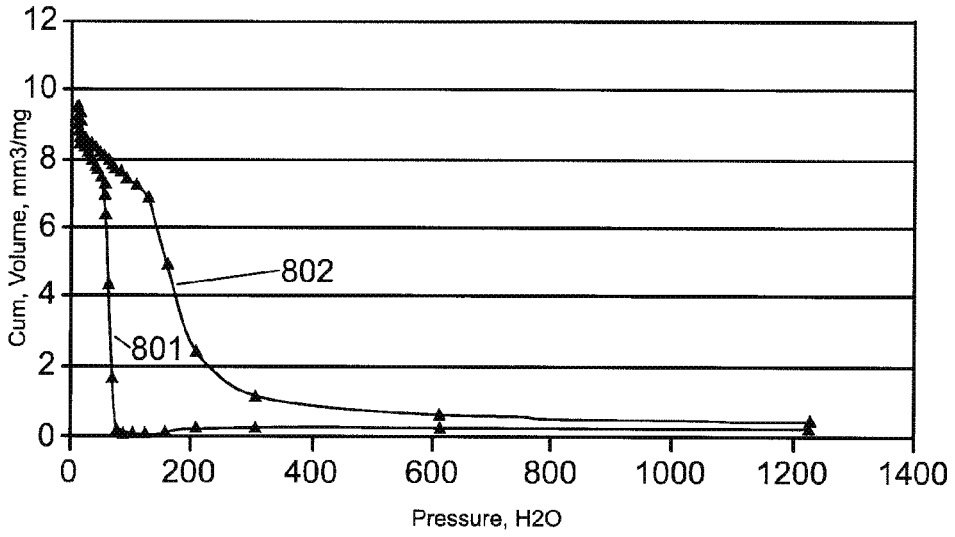
FIG. 8A illustrates the Fluid Uptake Curve of the substrate of FIG. 2.
Figure 8B:
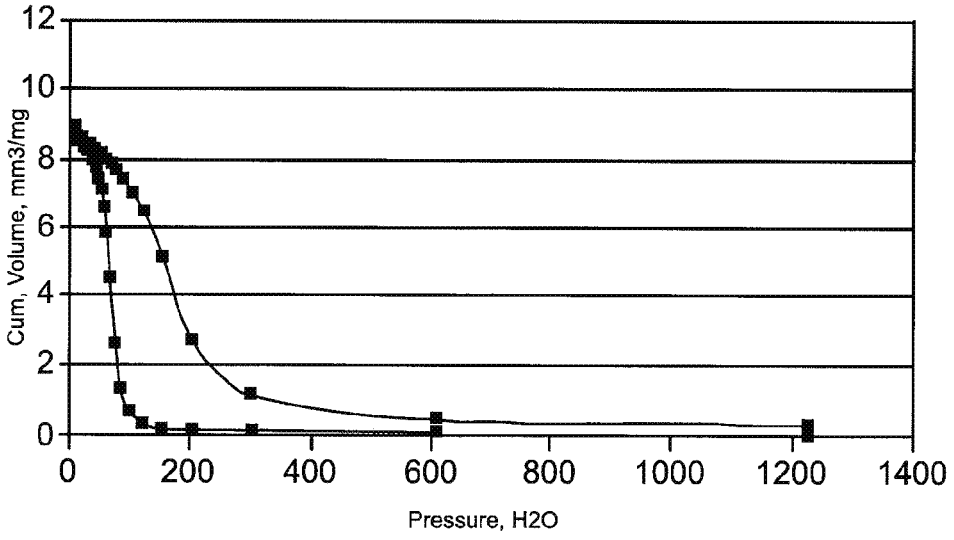
FIG. 8B illustrates the Fluid Uptake Curve of the substrate of FIG. 3.
Figure 9A:
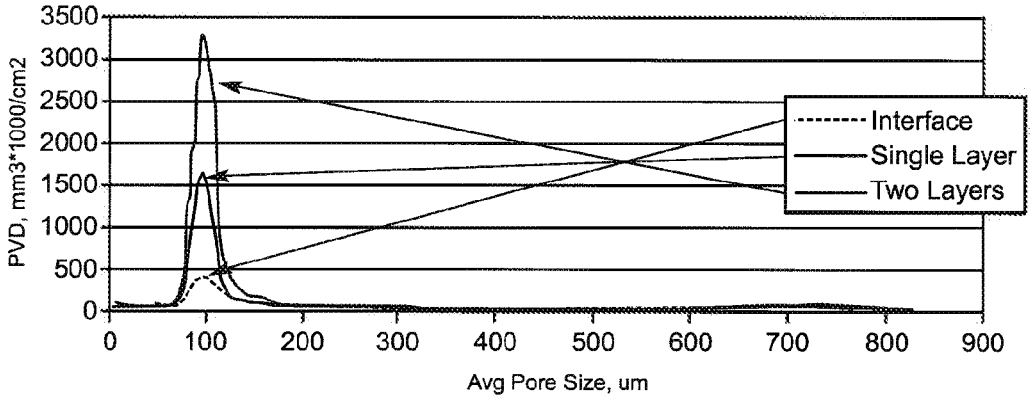
FIG. 9A is an Interfacial Pore Size Distribution for the substrate illustrated in FIG. 2.
Figure 9B:
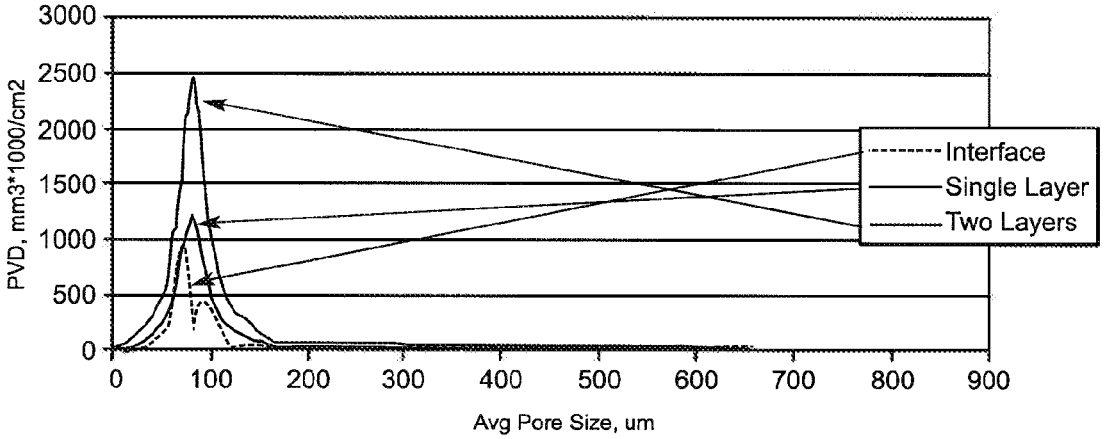
FIG. 9B is an Interfacial Pore Size Distribution for the prior art substrate illustrated in FIG. 3.

A representative Pore Size Distribution is shown as FIG. 7 for prior art substrate 300. A Fluid Uptake Curve for substrate 200, including both uptake curve 801 and de-watering curve 802, is shown as FIG. 8A. Similarly, a Fluid Uptake Curve for substrate 300 is shown in FIG. 8B. FIGS. 9A and 9B depicts interfacial pore-size distribution as calculated from the single layer (e.g. 1-ply) and two-layer (e.g. 2-ply) pore-size distributions. FIG. 9A depicts the interfacial pore-size distribution for the hydromolded pattern of substrate 200. FIG. 9B depicts the interfacial pore-size distribution for the hydromolded pattern of prior art substrate 300.

In this application of the TRI/Autoporosimeter, the liquid is a 0.1 weight % standard solution of octylphenoxy polyethoxy ethanol (Triton X-100 Solution from EMD, Product Number TX1568-1) in distilled water. The instrument calculation constants are as follows: $\rho$ (density)=1 g/cm3; $\gamma$ (surface tension)=30 dynes/cm2; cos $\Theta$=1°. A 1.2 μm Millipore Filter (Millipore Corporation, MA, product number RAWP09025) is employed on the test chamber's porous plate. A plexiglass plate approximately 5.5 $cm^2$ weighing 34 g (supplied with the instrument) is placed on the sample to ensure the sample rests flat on the Millipore Filter. Sample is same size as plexiglass plate. No additional weight is placed on the sample.

The remaining user specified inputs are described below. The sequence of pore sizes (pressures) for this application is as follows (effective pore radius in μm): 5, 10, 20, 30, 40, 50, 60, 70, 80, 90, 100, 110, 120, 130, 140, 150, 160, 170, 180, 190, 200, 210, 220, 230, 240, 250, 260, 270, 280, 290, 300, 325, 350, 400, 450, 500, 550, 600, 650, 700, 750, 800, 850, 800, 750, 700, 650, 600, 550, 500, 450, 400, 350, 325, 300, 290, 280, 270, 260, 250, 240, 230, 220, 210, 200, 190, 180, 170, 160, 150, 140, 130, 120, 110, 100, 90, 80, 70, 60, 50, 40, 30, 20, 10, 5. This sequence starts with the sample dry, saturates it as the pore settings increase ($1^{st}$ absorption), and then subsequently drains the sample of all volume above an effective pore radius of 5.0 μm ($1^{st}$ desorption). The equilibrium rate is set at 15 mg/minute or less. No stop radius is specified.

In addition to the test materials, a blank condition (no sample between plexiglass plate and Millipore Filter) is run to account for any surface and/or edge effects within the chamber. Any pore volume measured for this blank run is subtracted from the applicable pore grouping of the test sample. This data treatment can be accomplished manually or with the available TRI/Autoporosimeter Data Treatment Software, Release 2002.1.

The TRI/Autoporosimeter reports the pore volume contribution to the total pore volume of the specimen. The pore volume contributions are reported in units of $mm^3/cm^2$. Peak values on the plot of volume distribution and average pore size represent the most abundant average pore sizes and are reported as a means to characterize the porous media. The TRI/Autoporosimeter also reports the volume and weight at given pressures and radii. Pressure-volume curves can be constructed directly from these data and the curves are also commonly used to describe or characterize the porous media.

Average Pore Size

The average pore size of the interface is calculated from the pore-size distribution of the interface. The average pore-size of the interface is taken as the weighted-average of the pore-sizes as measured in the pore-size distribution of the interface over the range of pore sizes measured. The average pore size is calculated as follows:

$$\left(\frac{1}{\text{Total fluid volume uptake}}\right) \sum_{pore\ size} (\text{Pore size}) \times (\text{Fluid volume uptake at pore size})$$

Pore-size is reported as the effective radius of the capillaries in the porous medium, and average pore-size is reported as the weighted average of the effective radii of the pore-size of the sample.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wipes container comprising:

a first wipe comprising a first face and a second face, the first face of the first wipe comprising a hydromolded pattern thereon;

a second wipe comprising a first face and a second face, the first face of the second wipe comprising a hydromolded pattern thereonto;

wherein the first and second wipes comprise lotion;

wherein the first and second wipes are at least partially overlapped such that at least a portion of the second face of the first wipe is in contact with the second face of the second wipe; and wherein an average interfacial pore-size of the first and second wipes is greater than 300 microns in radius and less than 700 microns in radius, wherein the hydromolded pattern of the first wipe is formed on the first face via a continuous raised portion interspersed with a plurality of discrete recessed portions.

2. The wipes container of claim 1, wherein the raised portion is at least about 20% of the surface area of the first face.

3. The wipes container of claim 1, wherein the raised portion is at least about 40% of the surface area of the first face.

4. The wipes container of claim 1, wherein the raised portion is at least about 50% of the surface area of the first face.

5. The wipes container of claim 1, wherein at least one shape of the recessed portion is selected from the group consisting of a circle, a square, a rectangle, an oval, a triangle, an octagon, and a droplet.

6. The wipes container of claim 1, wherein a thickness of the raised portion is at least about 5% greater than a thickness of the recessed portion.

7. The wipes container of claim 1, wherein the pattern design prevents nesting.

8. The wipes container of claim 1, wherein the first wipe and the second wipe further comprises cotton fibers.

9. The wipes container of claim 1, wherein the first wipe and the second wipe each have an average pore size, and wherein the average interfacial pore size is greater than the average pore size of the first and second wipes.

10. A container of wipes comprising:

a housing; and a plurality of wipes at least partially overlapping one another and contained at least partially within the housing, each of the wipes having a first surface and an opposing second surface;

wherein the first surface of the wipes includes a raised portion and a plurality of recessed portions forming a pattern on the first surface of the wipes; and the pattern on the first surface of the wipes prevents the raised portions of a first wipe from nesting within the plurality of recessed portions of a second wipe, wherein the second wipe is overlapping with the first wipe, such that at least a portion of the second surface of the first wipe is in contact with the second surface of the second wipe, wherein an average interfacial pore-size of the first and second wipes is greater than 300 microns in radius and less than 700 microns in radius, and wherein the raised portion is continuous and the recessed portions are discontinuous.

11. The container of wipes of claim 10 wherein the raised portion comprises at least 20% of the area of the surface.

12. The container of wipes of claim 10 wherein the raised portion comprises at least 40% of the area of the surface.

13. The container of wipes of claim 10 wherein the raised portion comprises at least 50% of the area of the surface.

14. The wipes container of claim 10, wherein the wipes are interleaved with a Z-fold pattern.

* * * * *